US011794975B2

(12) United States Patent
Coon

(10) Patent No.: US 11,794,975 B2
(45) Date of Patent: Oct. 24, 2023

(54) EYEWEAR CASE AND PACKAGING SYSTEM HAVING IMPROVED HANG TAB

(71) Applicant: FGX INTERNATIONAL INC., Smithfield, RI (US)

(72) Inventor: Matthew Henri Coon, Providence, RI (US)

(73) Assignee: FGX INTERNATIONAL INC, Smithsfield, RI (US)

( * ) Notice: Subject to any disclaimer, the term of this patent is extended or adjusted under 35 U.S.C. 154(b) by 0 days.

(21) Appl. No.: 17/843,751

(22) Filed: Jun. 17, 2022

(65) Prior Publication Data

US 2022/0402672 A1 Dec. 22, 2022

Related U.S. Application Data

(60) Provisional application No. 63/202,606, filed on Jun. 17, 2021.

(51) Int. Cl.
*A45C 11/04* (2006.01)
*B65D 73/00* (2006.01)

(52) U.S. Cl.
CPC ..... *B65D 73/0064* (2013.01); *A45C 11/04* (2013.01)

(58) Field of Classification Search
CPC ..... B65D 73/0064; A45C 11/04
USPC ..... 206/5, 6, 284–287, 292–296, 461, 464, 206/466, 493, 806
See application file for complete search history.

(56) References Cited

U.S. PATENT DOCUMENTS

| | | | |
|---|---|---|---|
| 793,023 | A | 6/1905 | Paquette |
| 1,001,141 | A | 8/1911 | Grosskopf |
| 1,602,754 | A | 10/1926 | Delbridge |
| D113,402 | S | 2/1939 | Schram |
| 2,461,792 | A | 2/1949 | Weaver |
| D158,670 | S | 5/1950 | Klein |
| 3,000,417 | A | 9/1961 | Goldstein |
| 3,116,829 | A | 1/1964 | Pacelli |
| 3,273,702 | A | 9/1966 | Palmer |
| 3,333,726 | A | 8/1967 | Belanger |
| 3,416,185 | A | 12/1968 | Peterson |
| 3,462,020 | A | 8/1969 | Hall |
| 3,538,539 | A | 11/1970 | Allison |
| 3,608,705 | A | 9/1971 | Moshel |

(Continued)

FOREIGN PATENT DOCUMENTS

| | | |
|---|---|---|
| EP | 2783255 | 1/2018 |
| WO | WO2007122304 | 11/2007 |

OTHER PUBLICATIONS

RMS, FGX Reading Glasses TERRI value 3 Pack +1.50 https://generalwholesaledirect.com/products/fgx-reading-glasses-terri-value-3-pack-1-50.

(Continued)

*Primary Examiner* — Luan K Bui

(74) *Attorney, Agent, or Firm* — MALLOY & MALLOY, PL

(57) ABSTRACT

An eyewear case and packaging system is disclosed which includes an improved hang tab which permits the system to by displayed in a number of orientations and is easily removable in a tool-less manner to permit the packaging to be converted into a case. The improved hang tab includes at least one fastener which is dimensioned to be inserted through any one of a plurality of apertures in the case. The fastener is secured to the case via the interior by a retention member.

9 Claims, 2 Drawing Sheets

(56) References Cited

U.S. PATENT DOCUMENTS

| | | | | |
|---|---|---|---|---|
| 3,610,460 | A | 10/1971 | Siklos et al. | |
| 3,788,689 | A | 1/1974 | Lloyd | |
| 3,942,647 | A | 3/1976 | Crosslen | |
| 4,191,293 | A | 3/1980 | Newman | |
| D278,795 | S | 5/1985 | Fireman | |
| D282,718 | S | 2/1986 | Fireman | |
| D285,128 | S | 8/1986 | Yuen | |
| D286,507 | S | 11/1986 | Drago | |
| 4,695,140 | A | 9/1987 | Bononi | |
| D304,157 | S | 10/1989 | Holewinski | |
| D315,813 | S | 3/1991 | Nelson et al. | |
| 5,002,187 | A | 3/1991 | Rysner et al. | |
| D315,995 | S | 4/1991 | Miller | |
| D327,844 | S | 7/1992 | Wimbish et al. | |
| 5,129,617 | A | 7/1992 | MacWilliamson | |
| D329,552 | S | 9/1992 | Wells et al. | |
| D329,600 | S | 9/1992 | LaJoie | |
| 5,249,675 | A | 10/1993 | Strauss et al. | |
| D342,446 | S | 12/1993 | Parker et al. | |
| 5,284,259 | A | 2/1994 | Conway et al. | |
| D369,485 | S | 5/1996 | Lechleiter et al. | |
| 5,562,208 | A | 10/1996 | Hasler et al. | |
| D382,475 | S | 8/1997 | Cooper | |
| D386,966 | S | 12/1997 | Seelig | |
| D412,437 | S | 8/1999 | Josephs | |
| 6,003,663 | A | 12/1999 | Newcomer | |
| D422,139 | S | 4/2000 | Meikle | |
| 6,142,627 | A | 11/2000 | Winthrop | |
| D437,112 | S | 2/2001 | Toffoli | |
| 6,273,375 | B1 | 8/2001 | Kneep et al. | |
| 6,338,181 | B1 | 1/2002 | Hwang | |
| D453,901 | S | 2/2002 | Shepperson | |
| D494,228 | S | 8/2004 | Lane | |
| D505,866 | S | 6/2005 | Raile | |
| D506,396 | S | 6/2005 | Raile | |
| D506,681 | S | 6/2005 | Raile | |
| D508,843 | S | 8/2005 | Lane | |
| D510,530 | S | 10/2005 | Raile | |
| 7,055,680 | B2 | 6/2006 | Liebers | |
| D527,634 | S | 9/2006 | Liebers | |
| D536,261 | S | 2/2007 | Raile | |
| 7,188,739 | B1 | 3/2007 | Raile | |
| D549,990 | S | 9/2007 | Hsu | |
| D571,556 | S | 6/2008 | Raile | |
| D575,149 | S | 8/2008 | Baranowski | |
| D577,193 | S | 9/2008 | Raile | |
| D579,325 | S | 10/2008 | Bray et al. | |
| 7,523,909 | B1 | 4/2009 | Liebers et al. | |
| D617,554 | S | 6/2010 | Raile | |
| 7,762,511 | B1 | 7/2010 | Liebers et al. | |
| 7,938,535 | B2 | 5/2011 | Orlinksy et al. | |
| 8,016,111 | B2 * | 9/2011 | Wilson | A45F 5/1046 206/493 |
| 8,186,512 | B2 * | 5/2012 | Bertken | B65D 73/005 206/488 |
| 8,308,291 | B2 | 11/2012 | Norman et al. | |
| 8,337,016 | B2 | 12/2012 | Liebers et al. | |
| 8,393,463 | B1 | 3/2013 | Graham | |
| D679,329 | S | 4/2013 | Stravitz | |
| D681,444 | S | 5/2013 | Oja et al. | |
| D682,668 | S | 5/2013 | Anderson | |
| D687,183 | S | 7/2013 | Davis et al. | |
| 8,522,970 | B2 | 9/2013 | Hsieh | |
| D691,884 | S | 10/2013 | Kwon | |
| D694,099 | S | 11/2013 | Ensslen, III et al. | |
| 8,607,987 | B2 | 12/2013 | Oja et al. | |
| D697,398 | S | 1/2014 | Guevara-Ludt | |
| D699,988 | S | 2/2014 | Hawkins | |
| 8,833,571 | B2 | 9/2014 | Anderson | |
| D715,641 | S | 10/2014 | Spinos | |
| 8,955,671 | B1 * | 2/2015 | Barnett | B65D 11/12 206/806 |
| D729,518 | S | 5/2015 | Neusidl | |
| D780,847 | S | 3/2017 | Greenspon et al. | |
| D782,574 | S | 3/2017 | the Losen et al. | |
| D786,664 | S | 5/2017 | Lee | |
| 9,694,933 | B2 | 7/2017 | Kocon et al. | |
| D806,531 | S | 1/2018 | Fan | |
| D815,954 | S | 4/2018 | Choi et al. | |
| D816,484 | S | 5/2018 | Su | |
| D816,487 | S | 5/2018 | Su | |
| D818,821 | S | 5/2018 | Su | |
| D831,391 | S | 10/2018 | Grupenhof | |
| D856,716 | S | 8/2019 | Music et al. | |
| D857,427 | S | 8/2019 | Bird | |
| 10,479,580 | B1 | 11/2019 | McCumber | |
| D873,131 | S | 1/2020 | Watanabe | |
| D873,655 | S | 1/2020 | Rosebrook | |
| D885,884 | S | 6/2020 | Dietvorst et al. | |
| D887,283 | S | 6/2020 | Sennett et al. | |
| 10,738,520 | B2 | 8/2020 | Cherry et al. | |
| D901,947 | S | 11/2020 | Music et al. | |
| D909,888 | S | 2/2021 | Huang et al. | |
| D935,811 | S | 11/2021 | Dziura | |
| D935,879 | S | 11/2021 | Anderson | |
| D972,407 | S | 12/2022 | Coon et al. | |
| 2002/0189955 | A1 | 12/2002 | Waters | |
| 2006/0026795 | A1 | 2/2006 | Tonelli | |
| 2007/0215493 | A1 * | 9/2007 | Servis | A45C 11/04 206/5 |
| 2007/0220708 | A1 | 9/2007 | Lewis | |
| 2009/0051867 | A1 | 2/2009 | Mikame | |
| 2009/0108161 | A1 | 4/2009 | Liebers et al. | |
| 2009/0280971 | A1 | 11/2009 | Kunz | |
| 2010/0157239 | A1 * | 6/2010 | Orlinsky | A47F 7/0243 351/158 |
| 2010/0157242 | A1 | 6/2010 | Esser et al. | |
| 2010/0321633 | A1 | 12/2010 | De Rossi et al. | |
| 2012/0062832 | A1 | 3/2012 | Stanley | |
| 2012/0206690 | A1 | 8/2012 | Chen | |
| 2013/0038833 | A1 | 2/2013 | Berthezene et al. | |
| 2013/0062240 | A1 | 3/2013 | Trontel et al. | |
| 2013/0319896 | A1 | 12/2013 | Corbat et al. | |
| 2014/0173852 | A1 | 6/2014 | Heninger | |
| 2014/0209497 | A1 | 7/2014 | Jacobus | |
| 2015/0146164 | A1 | 5/2015 | Contet et al. | |
| 2015/0217920 | A1 | 8/2015 | Madron et al. | |
| 2015/0219924 | A1 | 8/2015 | Moine et al. | |
| 2015/0338682 | A1 | 11/2015 | Benoit et al. | |
| 2016/0101919 | A1 | 4/2016 | Zacherle et al. | |
| 2017/0184873 | A1 | 6/2017 | Rong et al. | |
| 2018/0371813 | A1 | 12/2018 | Cherry et al. | |
| 2021/0196085 | A1 | 7/2021 | Placencia et al. | |
| 2022/0402672 | A1 | 12/2022 | Coon | |

OTHER PUBLICATIONS

RMS, Select A Vision Semi-rimless Metal With Case +2.75 https://www.heb.com/product-detail/select-a-vision-semi-rimless-metal-with-case-2-75-each//2200279.

RMS, Select A Vision Value Pack Reading Glasses +2.00 https://www.heb.com/product-detail/select-a-vision-value-pack-reading-glasses-2-00/2133951.

* cited by examiner

EYEWEAR CASE AND PACKAGING SYSTEM HAVING IMPROVED HANG TAB

CLAIM OF PRIORITY

The present nonprovisional patent application claims priority pursuant to 35 U.S.C. § 119(e) to a prior filed provisional patent application, namely, that having Ser. No. 63/202,606 filed on Jun. 17, 2021, the contents of which are expressly incorporated herein by reference in its entirety.

BACKGROUND OF THE INVENTION

Field of the Invention

The invention pertains to a combined eyewear packaging and case system as well as an improved hang tab which can be employed with the system or on other retail products.

Description of the Related Art

Reducing the use of materials is an important goal in the retail sector. For products that are typically used with a carrying case, such as eyeglasses or sunglasses, the case presents a good opportunity to dispense with separate product packaging altogether. However, there is still a need to ensure that the products can be displayed in an orderly and attractive manner. As such, it is desirable to integrate a retail "hang tab" or hook into the case which can be easily removed by the user without tools in order to fully realize the dual use nature of the case. Furthermore, it is desirable to have a system which allows the products to be displayed in different orientations so that retailers have more flexibility in the space allocated to displays. The present invention solves these and other problems persistent in the art.

SUMMARY OF THE INVENTION

The present invention includes a carrying case which doubles as product packaging for display purposes. In a preferred embodiment, the case is made of a transparent material, such as clear plastic, so that the consumer and end user can easily identify the eyewear inside the case without having to open the case. This is ideal both for retail display, as it helps consumers select a desired style more efficiently, and for everyday use, as it helps a user distinguish between multiple pairs of eyewear.

One aspect of the invention includes an improved hang tab which can be removed by the user without the need for tools but is sturdy enough to support the product on a hanging retail display. The hang tab includes fasteners that interface with a number of mounting points around the case so that the case can be displayed in a variety of orientations. Once affixed to the case, a retention member can also be mated to the fastener from the interior of the case in order to further secure the hang tab.

In a preferred embodiment, the improved hang tab includes a hanging portion and at least one, but preferably two or more, fasteners projecting from the hanging portion. The fasteners include prongs having a curvilinear shape or configuration at their distal ends. The case includes a number of apertures which are dimensioned to provide an interference fit with the curvilinear configuration of the prongs. The fasteners may then be inserted into any one or a number of apertures to accommodate different display orientations. The prongs are appropriately sized and selected from an appropriately resilient material to accommodate the interference fit by elastically compressing together and springing apart when the fastener is inserted through the aperture. Because of the curvilinear configuration, and in contrast to the more typical "ramp and cliff" configuration common in this type of fitment, the same behavior will occur when the hang tab is removed from the case, i.e., the prongs will elastically compress together and spring apart once the fastener clears the edge of the aperture. In this regard, removal of the hang tab by a user, without the need for tools, is achieved far more efficiently than if the prongs had included a ramp and cliff configuration.

Because of the ease with which the hang tab may be removed, it may be desirable to provide an additional retention member in order to ensure that the hang tab cannot be jostled free or that the weight of the product hanging from the hang tab does not release it from the case. In one embodiment, the retention member can be inserted between the prongs to physically prevent the prongs from compressing together, thereby obstructing the withdrawal of the fastener from the aperture.

In a preferred embodiment, where a plurality of fasteners are employed, the retention member can include a plurality of feet connected by a spacer bar. The feet are dimensioned and configured to be inserted between the prongs, while the spacer bar supports the feet and provides a structure for the user to easily grip and remove all feet at once. Additionally, the feet may include notches dimensioned and configured to seat the feet between each prong and ensure a stable orientation so that the feet are not jostled free during transport and other handling.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
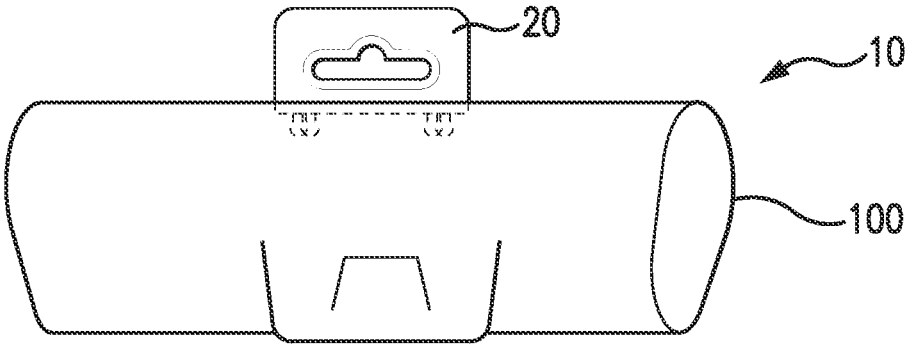
FIG. 1 is a front view of an eyewear case and packaging system with an improved hang tab disposed in a first orientation according to one embodiment of the invention.
Figure 2:
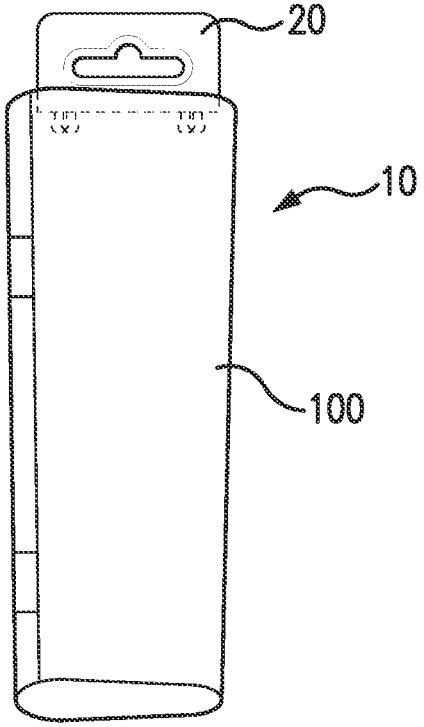
FIG. 2 is a front view of an eyewear case and packaging system with an improved hang tab disposed in a second orientation according to one embodiment of the invention.

The present invention includes an eyewear case and packaging system 10 having and improved hang tab 20 which can be installed in a number of locations and orientations to facilitate retail display. By way of non-limiting example, FIG. 1 depicts a horizontal orientation of the housing 100, while FIG. 2 depicts a vertical orientation of the housing 100. The hang tab 20 is interchangeable between different configurations as may be desired according to the shape of the housing 100, in order to provide flexibility to retailers to determine how goods are best displayed.

Figure 3:
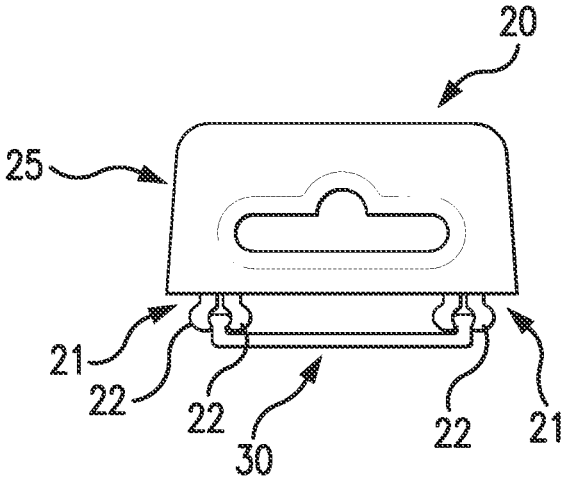
FIG. 3 is a front view of an improved hang tab with a retention member installed according to one embodiment of the invention.
Figure 4:
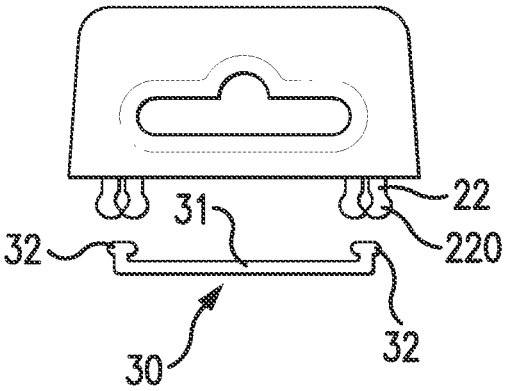
FIG. 4 is a front view of an improved hang tab with a retention member removed according to one embodiment of the invention.
Figure 5:
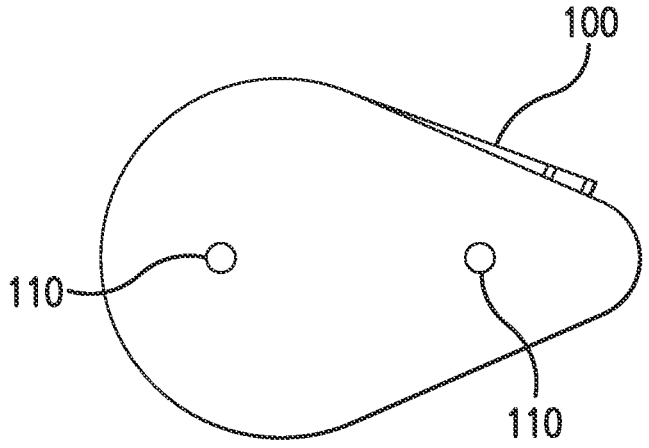
FIG. 5 is a side view of an eyewear case and packaging system according to one embodiment of the invention.
Figure 6:
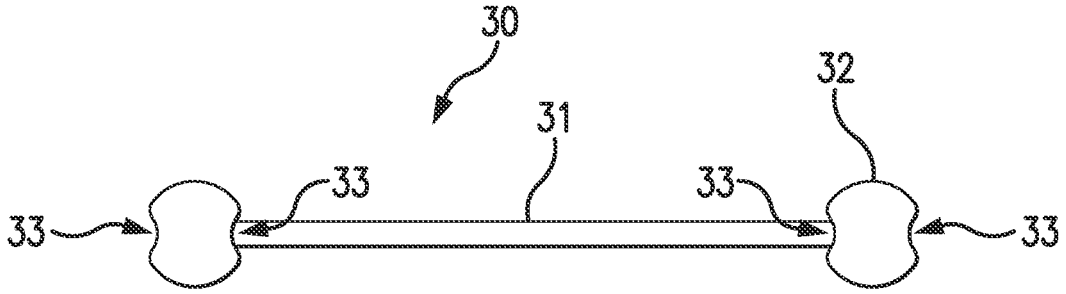
FIG. 6 is an enlarged top view of a retention member according to one embodiment of the invention.

As can be seen most apparently in FIGS. 3 and 4, an improved hang tab 20 is depicted as well as the interaction of the improved hang tab 20 with a retention member 30 according to one embodiment of the present invention. The improved hang tab 20 includes a hanging portion 25 which, in a preferred embodiment, can include any of a variety of geometries that are known and utilized for standard and common retail store displays. This can include, but is certainly not limited to, a hook, an eye, a triangular aperture, or the depicted "sombrero" style hanger. Protruding from the hanging portion 25 is at least one fastener 21, but preferred embodiments may also include two or more fasteners 21. The fastener 21 is dimensioned and configured to be inserted into an aperture 110 of the housing 100 (as depicted in FIG. 5) such that at least a portion of the fastener 21 passes into the interior of the housing 100. Once inserted through the aperture 110, the fastener 21 can be mated with a retention member 30 to securely and releasably affix the improved hang tab 20 to the housing 100.

More specifically, and now with reference to FIGS. 3 through 6, in the depicted embodiment the fastener 21 is comprised of two prongs 22 having curvilinear configurations 220 at their distal ends. The proximal ends of the prongs 22 are dimensioned and configured to flex elastically to facilitate use. It will be appreciated that material selection will be important to achieving the requisite elastic behavior, such as a sufficiently resilient polymer. However, given that the intended use of the improved hang tab 20 is to be inserted at the time of manufacture and removed by the end user (essentially one-time use), a significant number of stress cycles are not to be expected.

In one embodiment, the distance between the outer edges of the curvilinear configurations 220 on the prongs is larger than the diameter of the apertures 110. As such, when inserted into the apertures 110 the prongs 22 will tend to compress due to the wedge action as the curvilinear configuration 220 passes the edge of the aperture 110. If the prongs 22 are sufficiently long (or if the housing 100 is sufficiently thin) the prongs 22 will decompress and expand back to a relaxed state once the curvilinear configurations 220 completely clear the apertures 110. In order to remove the improved hang tab 20 a user may pull on the hanging portion 25, which will cause the curvilinear portions 220 to interact with the edge of the apertures 110 and further cause the prongs 22 to compress, thereby allowing the fasteners 21 to clear the apertures 110.

In order to prevent removal of the improved hang tab 20 until a user wishes to transform the packaging into a case, and to do so in a tool-less manner, a retention member 30 can be supplied and affixed to the fasteners 21, which is accessible to the user from the interior of the housing 100. In the depicted embodiment the retention member 30 includes a foot 32 that is dimensioned and configured to be retained between the prongs 22 at the curvilinear configuration 220. In a preferred embodiment, the foot includes one or more notches 33 that are designed to seat the foot 32 within the prongs 22 in a stable fashion, in order to help ensure that the retention member 30 cannot be jostled free. In a most preferred embodiment, the foot 32 and the distance between the notches 33 are dimensioned and configured to be received by the prongs 22 in an interference fit which causes the prongs 22 to flex outward. This mechanism helps ensure that the fasteners 21 cannot be removed from the apertures merely by pulling on the hanging portion 25 (or by the weight of the product pulling down on the hanging portion 25). In a most preferred embodiment, the retention member 30 includes a plurality of feet 32 connected by a spacer bar 31. The spacer bar 31 not only ensures a stable configuration but also provides the user with something to grasp in order to easily remove the retention member 30 from the fasteners.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An eyewear case and packaging system comprising:
- a housing including a plurality of apertures;
- a hang tab including a hanging portion and at least one fastener;
- a retention member;
- said fastener being correspondingly dimensioned and configured to pass through any one of said plurality of apertures from an exterior of said housing;
- said retention member being correspondingly dimensioned and configured to releasably affix said fastener inside of said housing.

2. The eyewear case and packaging system as recited in claim 1 wherein said hang tab includes at least two fasteners.

3. The eyewear case and packaging system as recited in claim 1 wherein said fastener comprises a pair of prongs each having a curvilinear configuration at their distal ends.

4. The eyewear case and packaging system as recited in claim 3 wherein said retention member is dimensioned and configured to be disposed between said prongs in an interference fit, thereby causing said prongs to elastically deform.

5. The eyewear case and packaging system as recited in claim 4 wherein said elastic deformation of said prongs is sufficient to cause said curvilinear members to be disposed apart from each other at a distance greater than the diameter of said aperture, thereby preventing removal of said fastener from said aperture.

6. The eyewear case and packaging system as recited in claim 3 wherein said retention member includes at least one foot, said at least one foot having at least one notch, said notch and said foot collectively dimensioned and configured to be received by said curvilinear configuration in an interference fit.

7. The eyewear case and packaging system as recited in claim 3 wherein said curvilinear configuration causes a distance between said pair of prongs to be larger than said aperture at some point along the curvilinear configuration.

8. The eyewear case and packaging system as recited in claim 7 wherein said pair of prongs are dimensioned and configured to elastically deform as said fastener is inserted through or removed from said aperture.

9. The eyewear case and packaging system as recited in claim 7 wherein said aperture and said prongs are correspondingly dimensioned and configured to permit said fastener to relax into an undeformed state when said curvilinear portions have passed through said aperture.

* * * * *